US010235971B1

(12) United States Patent
Chen et al.

(10) Patent No.: US 10,235,971 B1
(45) Date of Patent: Mar. 19, 2019

(54) SYSTEM AND METHOD FOR ENHANCING DISPLAY UNIFORMITY AT DISPLAY BOUNDARIES

(71) Applicant: Solomon Systech (Shenzhen) Limited, Shenzhen, Guangdong (CN)

(72) Inventors: Jun Chen, Hong Kong (HK); Cheung Fai Lee, Hong Kong (HK); Shu Shing Ching, Hong Kong (HK); Wai Keung Lau, Hong Kong (HK)

(73) Assignee: Solomon Systech (Shenzhen) Limited, Shenzhen (CN)

( * ) Notice: Subject to any disclaimer, the term of this patent is extended or adjusted under 35 U.S.C. 154(b) by 0 days.

(21) Appl. No.: 15/921,649

(22) Filed: Mar. 14, 2018

(51) Int. Cl.
*G09G 5/10* (2006.01)

(52) U.S. Cl.
CPC ..... *G09G 5/10* (2013.01); *G09G 2310/061* (2013.01); *G09G 2320/0233* (2013.01)

(58) Field of Classification Search
None
See application file for complete search history.

(56) References Cited

U.S. PATENT DOCUMENTS 9,569,030 B2 * 2/2017 Kim ..... G06F 3/044

* cited by examiner

*Primary Examiner* — Kenneth B Lee, Jr.

(57) ABSTRACT

Disclosed is a system and method for enhancing display uniformity at display boundaries. A memory stores multiple input data patterns comprising pixel data to be displayed for multiple display time intervals. A comparator receives input data patterns for a preceding time interval. The comparator compares the difference between a pixel data associated with a pixel of a current line and a preceding line with a predefined threshold. A display controller determines a rescan pattern corresponding to a blanking time interval between the preceding display time interval and a current display time interval by driving the pixel data using a look-up table. The display panel displays the input data patterns corresponding to current display time interval after the blanking time interval having the rescan pattern such that coherency amongst display characteristics of the current display time interval and the preceding display time interval is achieved.

17 Claims, 15 Drawing Sheets

SYSTEM AND METHOD FOR ENHANCING DISPLAY UNIFORMITY AT DISPLAY BOUNDARIES

TECHNICAL FIELD

The present application described herein, in general, relates to an electronic device display panel. In particular, the present application relates to a system for enhancing display uniformity at display boundaries.

BACKGROUND

Recently, technological advanced display panels have been developed in order to cater numerous customer-centric applications. With the flourishing development in the technology of display panels, it is a market and customer demand for high performance display panels. The display panels providing high resolution, high brightness and low-power consumption are most preferred. However, it is observed that, non-uniformities in brightness (e.g., dim lines or bright lines) along the display boundaries have been a critical quality issue impending the design, especially when the panel load increases.

The behaviors of the display electrodes are different between blanking and display time intervals of the display panel. This is because the panel loads are different between blanking and display time intervals. When the IC resumes display after the blanking time interval, the brightness of first few display lines after the blanking time interval differs from others. Therefore, there is a long-standing need of a system for enhancing display uniformity at blank or display boundaries of the display panel.

SUMMARY

This summary is provided to introduce concepts related to a system and method for enhancing display uniformity at display boundaries and the concepts are further described below in the detailed description. This summary is not intended to identify essential features of the claimed subject matter nor is it intended for use in determining or limiting the scope of the claimed subject matter.

In one embodiment, a system for enhancing display uniformity at display boundaries is disclosed. The system may include a memory configured to store a plurality of input data patterns, corresponding to N lines of a display panel, to be displayed for a plurality of predefined display time intervals. In one aspect, each two adjacent display time intervals may be separated via a blanking time interval. In another aspect, the plurality of input data patterns comprises pixel data corresponding to each of the N lines for each display time interval. The system may further include a comparator configured to receive input data patterns corresponding to N lines for a preceding display time interval from the memory. The comparator may further be configured to compare difference between a pixel data associated with a pixel of a current line, of the N lines of the display panel, and a pixel data associated with a corresponding pixel of a preceding line, of the N lines of the display panel, corresponding to the preceding display time interval with a predefined threshold. The display controller may be configured to determine the rescan pattern by driving the pixel data associated with the pixels of the N lines corresponding to the preceding display time interval during the blanking time interval between the preceding display time interval and the current display time interval. In one aspect, the pixel data is driven using a look-up table to modify or retain the value of the pixel data associated with the pixels of the N lines based upon the difference between the pixel data associated with each pixel of the current line and the pixel data associated with the corresponding pixel of the preceding line being greater than a predefined threshold, and less than or equal to the predefine threshold respectively. The system may further include a display panel configured to display input data patterns corresponding to the current display time interval after the blanking time interval having the last predetermined number of lines with the rescan pattern such that, the display characteristics of the input data patterns corresponding to the current display time interval are in coherent with the display characteristics of the input data patterns corresponding to the preceding display time interval. In one embodiment, the display characteristics include at least brightness and dimming effects.

In another embodiment, a method for enhancing display uniformity at display boundaries is disclosed. The method may include storing, via a memory, a plurality of input data patterns, corresponding to N lines of a display panel, to be displayed for a plurality of predefined display time intervals. In one aspect, each two adjacent display time intervals are separated via a blanking time interval, wherein the plurality of input data patterns comprises pixel data corresponding to each of the N lines for each display time interval. The method may include receiving, via a comparator, input data patterns corresponding to N lines for a preceding display time interval from the memory. The method may furthermore include comparing, via the comparator, difference between a pixel data associated with a pixel of a current line, of the N lines of the display panel, and a pixel data associated with a corresponding pixel of a preceding line, of the N lines of the display panel, corresponding to the preceding display time interval with a predefined threshold. The method may further include determining, via a display controller, a rescan pattern corresponding to the last predetermined number of lines of the blanking time interval between the preceding time interval and a current display time interval. The rescan pattern may be determined by driving the pixel data associated with the pixels of the N lines corresponding to the preceding display time interval during the blanking time interval between the preceding display time interval and the current display time interval. In one aspect, the pixel data may be driven using a look-up table to modify or retain the value of the pixel data associated with the pixels of the N lines based upon the difference between the pixel data associated with each pixel of the current line and the pixel data associated with the corresponding pixel of the preceding line being greater than a predefined threshold, and less than or equal to the predefine threshold respectively. The method may include displaying, via a display panel, the input data patterns corresponding to current display time interval after the blanking time interval having the last predetermined number of lines with the rescan pattern such that, the display characteristics of the input data patterns corresponding to the current display time interval are in coherent with the display characteristics of the input data patterns corresponding to the preceding display time interval. In one embodiment, the display characteristics include at least brightness and dimming effects.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

Figure 1:
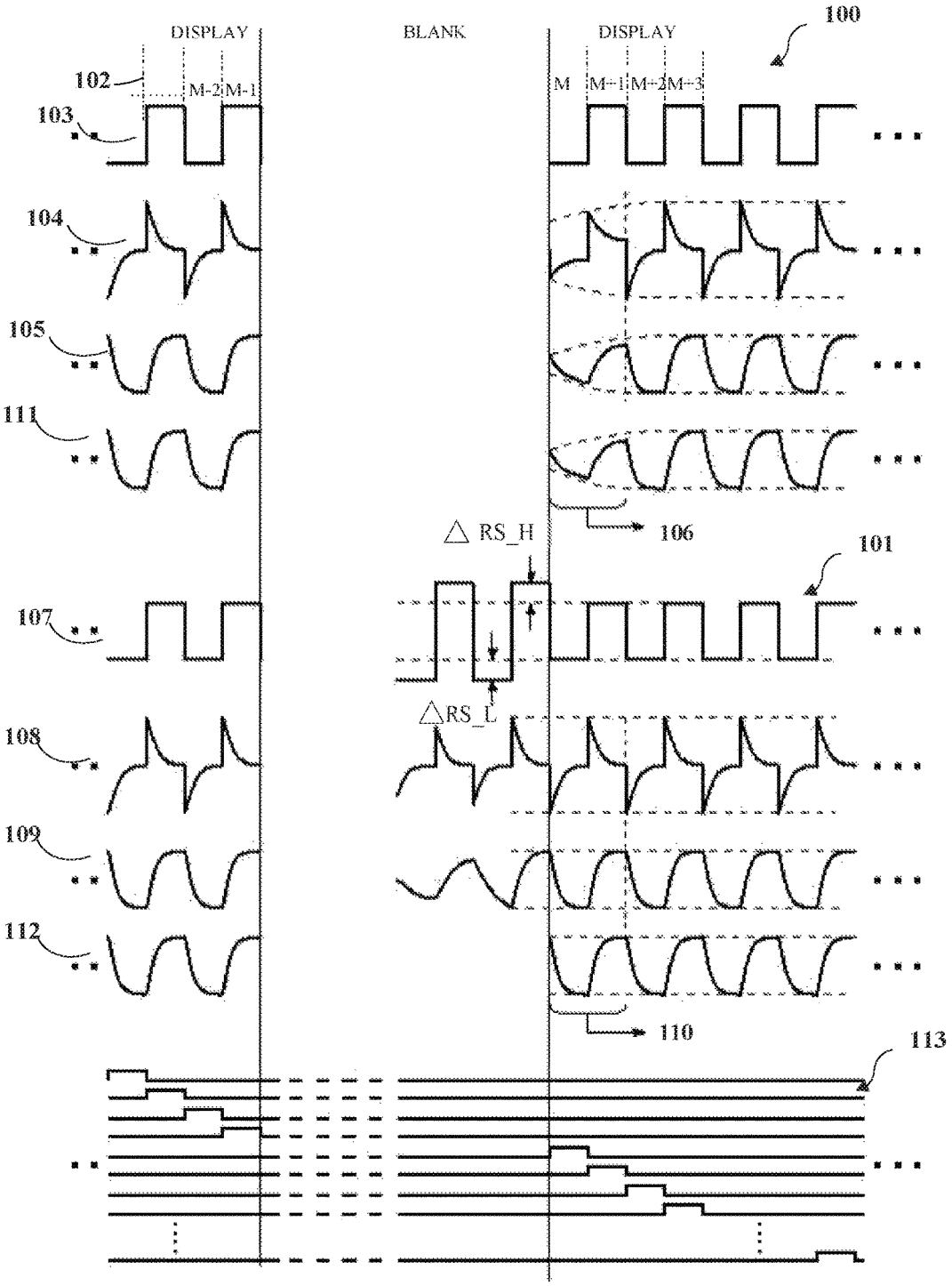
FIG. 1 illustrates a multi-line playback rescan (100, 101), in accordance with an embodiment of the present application.

Referring to FIG. 1, a multi-line playback rescan 100 is illustrated in accordance with an embodiment of the present application. In order to make the behaviors of display electrodes of a display panel similar with those at the end of the last display time interval, so that the electrodes get ready for the new display time interval, rescan of the display lines may be performed at the end of the blanking time interval. In one embodiment, the display panel may include of N lines. Amplitude adjustment for different patterns may be done by rescanning the N lines. In one embodiment, said N lines may be multiples of gate clock cycle or multiples of data pattern cycle. The data pattern cycle may be the last M−1, M−2, . . . , M−N lines before a blanking time interval of the display panel. The amplitude adjustment of the lines may be dependent on input data or panel characteristics including, but not limited to, loading, panel design, panel drawing or line characteristics. In one embodiment, a common electrode VCom may be adjustable in order to strengthen or weaken driving capabilities of the line of the display panel. In one embodiment, gate/MUX timing may be adjustable for different TFT on time.

According to FIG. 1, the multi-line playback rescan 100 may include alternate display time intervals and blanking time intervals of the display panel. FIG. 1 of the multi-line playback rescan 100 illustrates graphs depicting output line numbers 102, original source output 103, original VCom coupling 104, original potential difference between source and VCom 105, original LC electrode potential 111. In one embodiment, at a first display time interval, the above-mentioned signals may have maximum amplitudes. Further, in the successive blanking time interval of the display panel, said signals may be absent or switched off. Furthermore, in the successive display time interval after the blanking time interval, the display panel may depict the change in the signal or original LC electrode potential 111. The change depicts the signal amplitude when the display resumes from the blank. First few scan lines 106 such as M, M+1, may appear to be non-uniform in brightness.

Further, referring FIG. 1, the multi-line playback rescan 101 illustrates graphs depicting overdriven source output 107, compensated VCom coupling 108, compensated potential difference between source and VCom 109, and compensated LC electrodes potential 112. With consideration of the output line numbers 102 at the last few lines such as M−2, M−1, of the first display time interval, the overdriven source output 107 may provide overdrive or underdrive voltages to the original source output 103 for a rescan time interval. The rescan time interval may be included in the blanking time interval, preceding the second display time interval. In one embodiment, during the multi-line playback rescan 100, the input data pattern corresponding to output line numbers 102, such as last N lines of the display time interval namely M−1, M−2, . . . , M−N may be memorized. In order to carry out the basing on the levels of the input data pattern, the compensation values of $\Delta_{RS_L}$ and $\Delta_{RS_H}$ may be applied to the data. Therefore, when the display resumes from the blanking time interval, first few scan lines 110 may reach the intended intensity. In one embodiment, the multi-line playback rescan 100 may shorten the rescan time interval, reduce memory requirement for storing the input data pattern, and compensate the intrinsic panel load difference between the rescan time interval and the display time interval. As can be clearly seen from FIG. 1, TFT gates 113 are not turned ON when pixel data is driven during the rescan time interval.

Figure 2A:
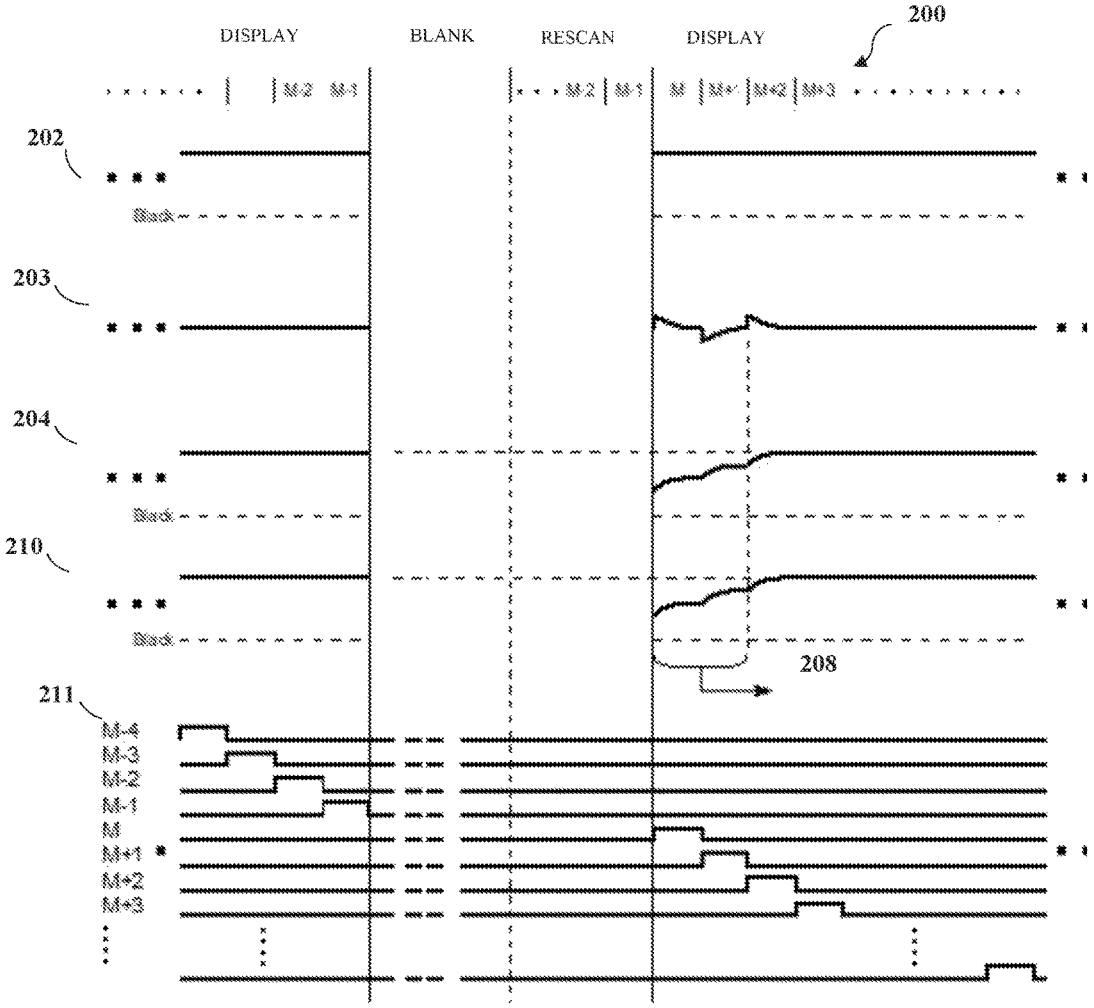
FIG. 2(*a*) and FIG. 2(*b*) illustrate a multi-line playback rescan for solid pattern 200, in accordance with an embodiment of the present application.
Figure 2B:
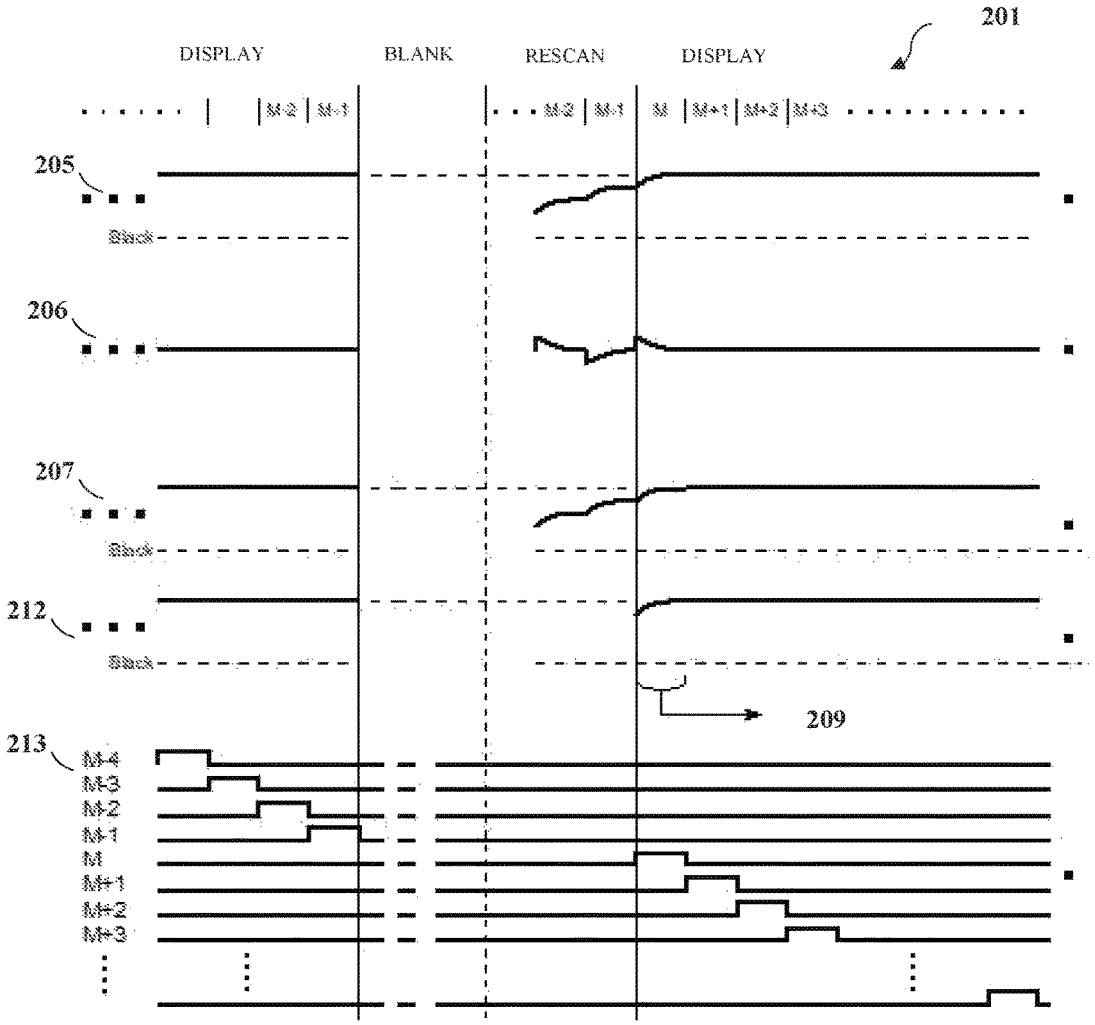

Referring to FIGS. 2(*a*) and 2(*b*), a multi-line playback rescan for solid pattern 200 and 201 are illustrated in accordance with the present subject matter. The multi-line playback rescan for solid pattern 200 may include alternate display and blanking time intervals of the display panel. The blanking time interval may include rescan. FIG. 2(*a*) shows graphs depicting original source output 202, original VCom coupling 203, original potential difference between source and VCom 204, and original LC electrode potential 210. In one embodiment, the original source output 202 at the end of the first display time interval may keep no change or relatively show a small change. At the first few display lines, potential difference on original LC electrode potential 210 may distort. When the display may resume from the blanking time interval, first few scan lines 208 may appear to be non-uniform in brightness.

FIG. 2(*b*) of the multi-line playback rescan for solid pattern 201 shows graphs depicting overdriven source output 205, compensated VCom coupling 206, compensated potential difference between source and VCom 207 and compensated LC electrodes potential 212. During rescan, the original source output 202 and original VCom coupling 203 may behave like the last few lines of the first display time interval. Therefore, at the first few display lines, the potential difference on compensated LC electrodes potential 212 may not distort. When the display resumes from the blanking time interval, the first scan line 209 reach the intended intensity. As can be clearly seen from FIG. 2(*a*) and FIG. 2(*b*), the TFT gates (211, 213) are not turned ON when pixel data is driven during the rescan time interval.

Figure 3A:
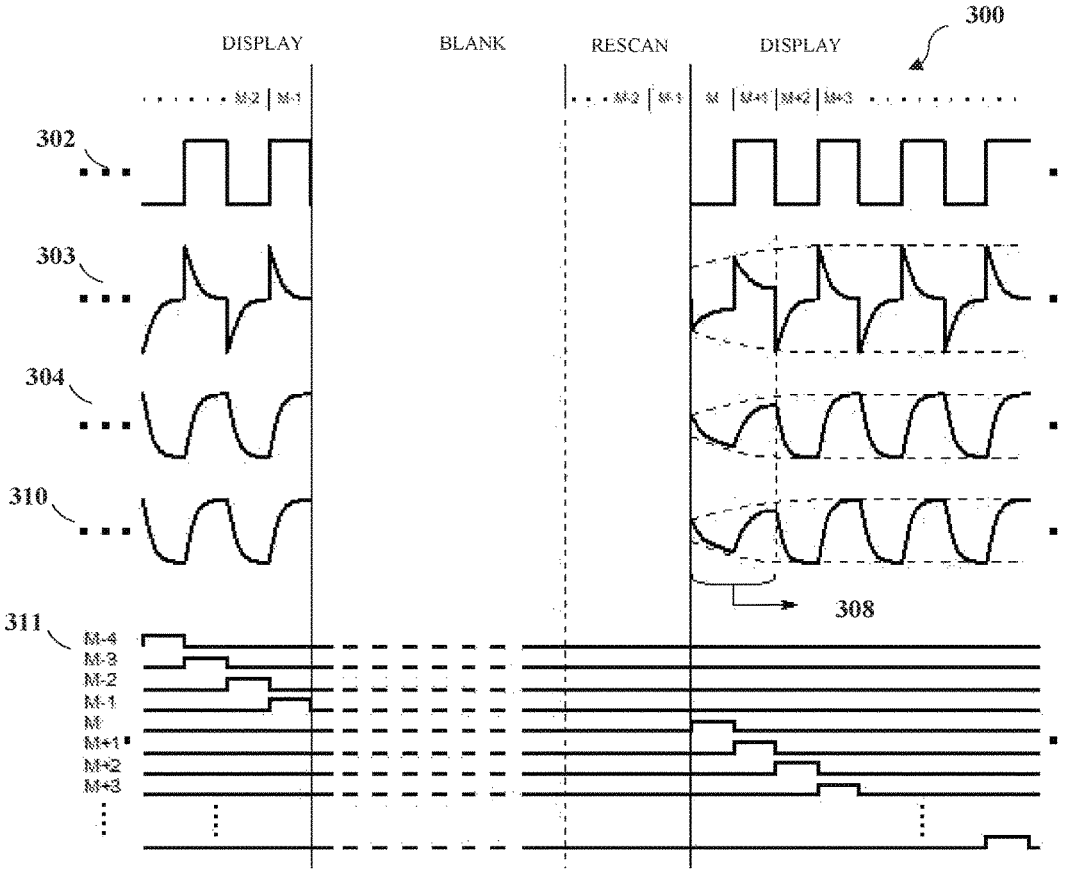
FIG. 3(*a*) and FIG. 3(*b*) illustrate a multi-line playback rescan for checker pattern 300, in accordance with an embodiment of the present application.
Figure 3B:
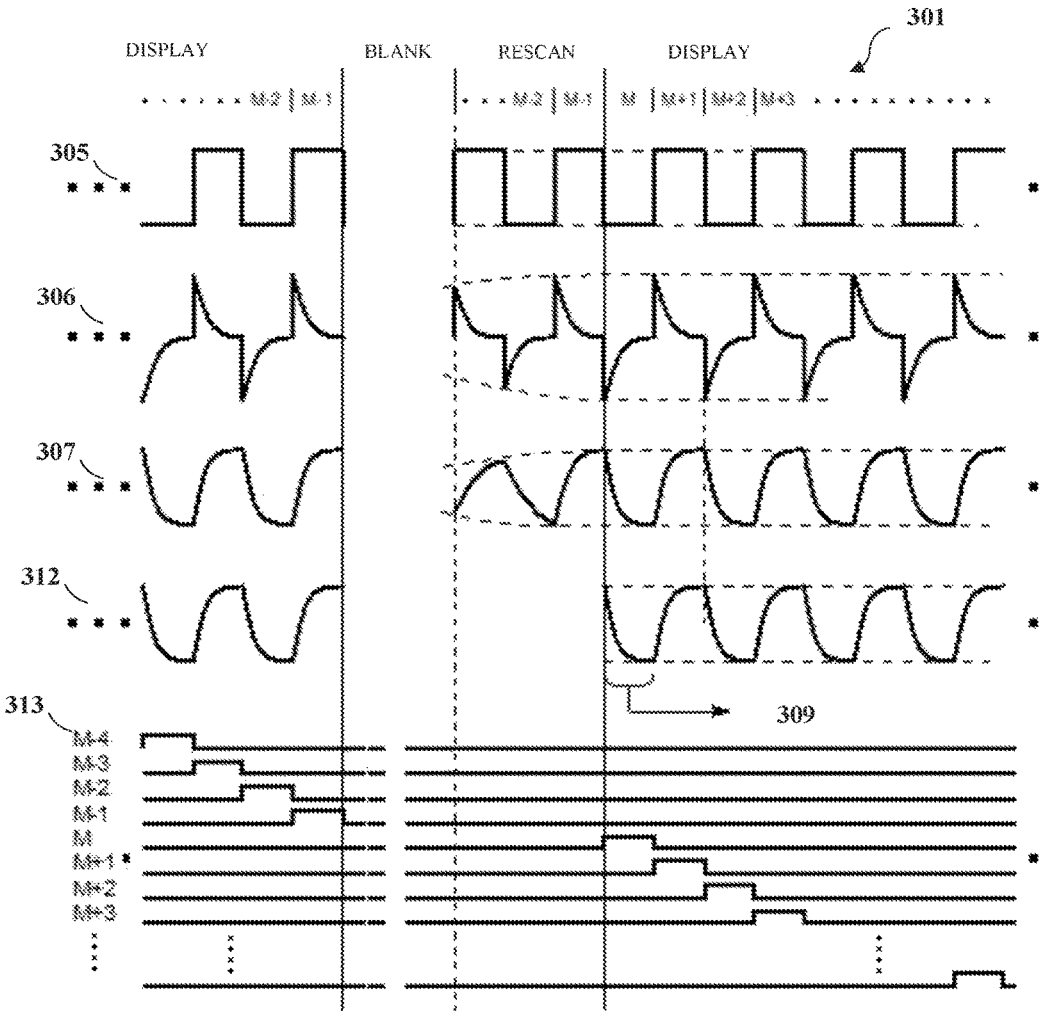

Referring to FIGS. 3(*a*) and 3(*b*), a multi-line playback rescan for checker pattern 300 and 301 are illustrated in accordance with the present subject matter. FIG. 3(*a*) shows graphs depicting original source output 302, original VCom coupling 303, original potential difference between source and VCom 304, and original LC electrode potential 310. FIG. 3(*b*) shows graphs depicting overdriven source output 305, compensated VCom coupling 306, compensated potential difference between source and VCom 307, and compensated LC electrode potential 312. In one embodiment, original source output 302, at the end of the first display time interval may toggle at checker pattern. At the first few display lines, potential difference on original LC electrode potential 310 may distort. When the display may resume from the blanking time interval, first few scan lines 308 may appear to be non-uniform in brightness. During rescan, the original source output 302 and original VCom coupling 303 may behave like the last few lines of the first display time interval. Therefore, at the first few display lines, the potential difference on compensated LC electrodes potential 312 may not distort. When the display resumes from the blanking time interval, the first scan line 309 reach the intended intensity. As can be clearly seen from FIG. 3(*a*) and FIG. 3(*b*), the TFT gates (311, 313) are not turned ON when pixel data is driven during the rescan time interval.

Figure 4A:
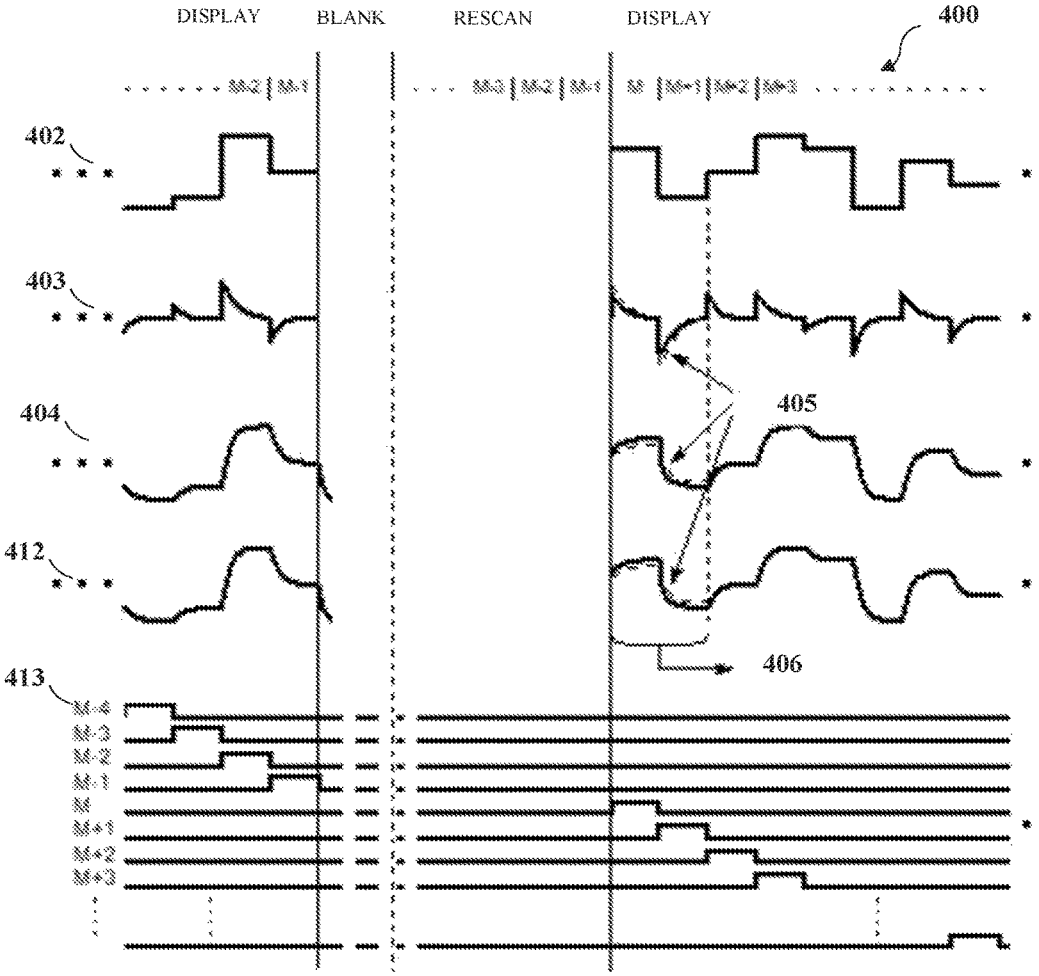
FIG. 4(*a*) and FIG. 4(*b*) illustrate a multi-line playback rescan for random pattern 400, in accordance with an embodiment of the present application.
Figure 4B:
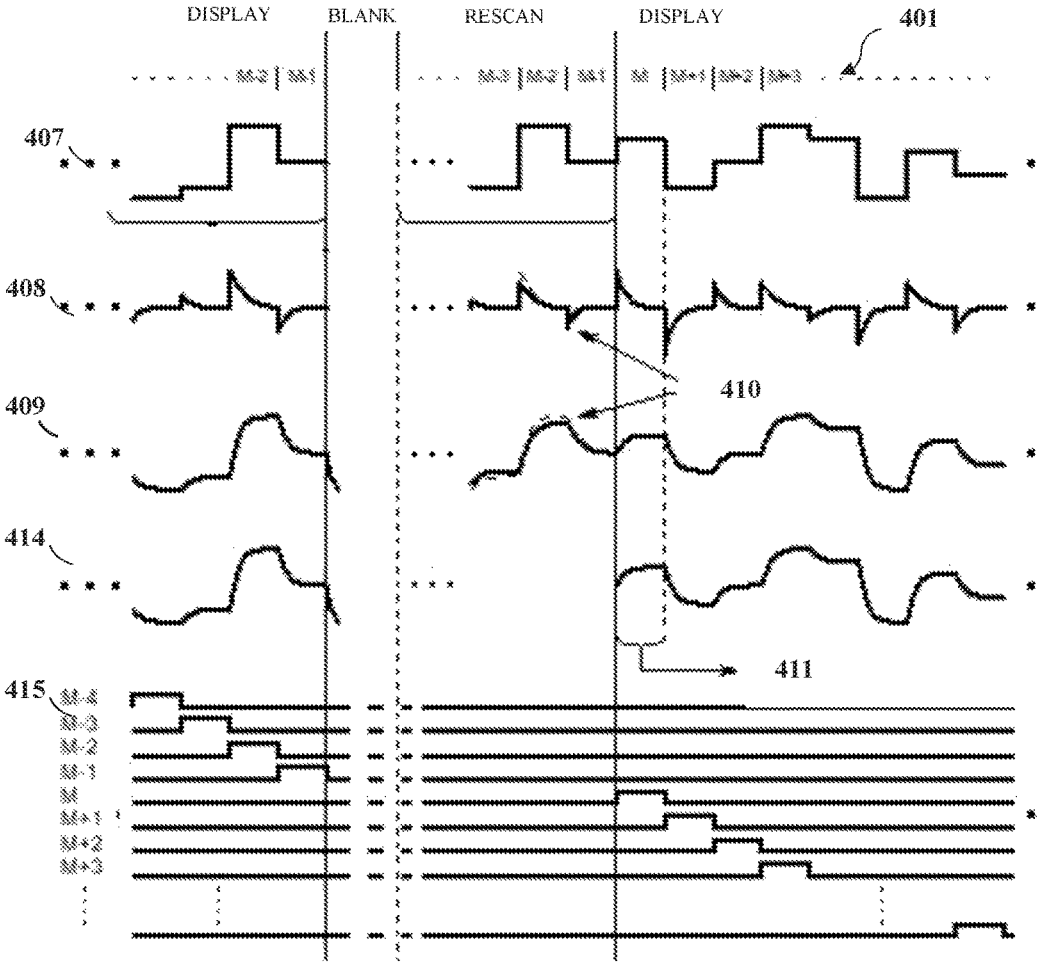

Referring to FIGS. 4(*a*) and 4(*b*), a multi-line playback rescan for random pattern 400 and 401 are illustrated in accordance with the present subject matter. FIG. 4(*a*) shows graphs depicting original source output 402, original VCom coupling 403, original potential difference between source and VCom 404, and original LC electrode potential 412. FIG. 4(*b*) shows graphs depicting overdriven source output 407, compensated VCom coupling 408, compensated potential difference between source and VCom 409, and compensated LC electrode potential 414. In one embodiment, original source output 402, at the end of the first display time interval may toggle at random pattern. At the first few display lines, potential difference on original LC electrode potential 412 may distort. At the second display time interval, seam may be visible because the actual response differs from the expected behavior of continuous scanning 406. During rescan, the original source output 402 and original VCom coupling 403 may behave like the last few lines of the first display time interval. Therefore, at the first few display lines, the potential difference on compensated LC electrodes potential 414 may not distort. In one embodiment, if the display scanning may be continuous, the difference diminishes after few scan lines 405, 410. At the second display time interval, seam may not be visible because the actual response is same as the expected behavior of continuous scanning 411. As can be clearly seen from FIG. 4(*a*) and FIG. 4(*b*), the TFT gates (413, 415) are not turned ON when pixel data is driven during the rescan time interval.

In one embodiment of the present application, a compensation value look-up table is provided, wherein the compensation value look-up table is a hardware-friendly implementation of input data processing. According to the experience to human eyes, sensitivity to different levels of gamma curve, a gamma curve with 256 levels are divided into 5 regions such as 0~63, 64~111, 112~143, 144~191, 192~255. The region divisions near 0-255 are coarse and the region divisions near 128 are fine because human eyes are less sensitive to dark/bright levels and are sensitive to mid-levels of gamma curve. Depending on the values of current pixel data, the display controller may look up the compensation values in the table. The compensation values may be implemented as 9 bit registers (MSB is + or −, the other 8 bits represents 256 levels). The compensation values for regions near 0 or 255 are relatively large, values for regions near 128 are relatively small, because human eyes are less sensitive to dark/bright levels and are sensitive to mid-levels of gamma curve.

TABLE 1

| Current Pixel data | Compensation (5 9 bit registers) | Application example of Compensation values |
|---|---|---|
| 0 . . . 63 | ΔRS_L | −30 |
| 64 . . . 111 | ΔRS_ML | −20 |
| 112 . . . 143 | ΔRS_M | 0 |
| 144 . . . 191 | ΔRS_MH | +20 |
| 192 . . . 255 | ΔRS_H | +30 |

Figure 5:
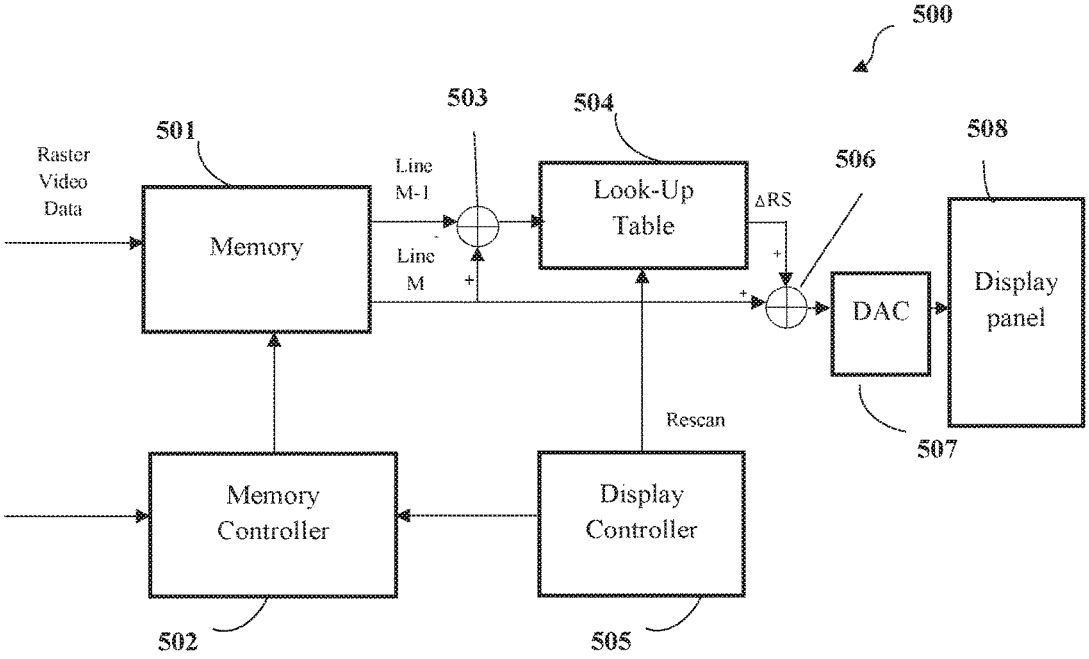
FIG. 5 illustrates a circuit implementation diagram 500 for enhancing display uniformity at display boundaries, in accordance with an embodiment of the present application.

Now, referring to FIG. 5, a circuit implementation diagram 500 for enhancing display uniformity at display boundaries is illustrated in accordance with an embodiment of the present application. In one embodiment, the circuit may include a display panel 508, a memory 501, a look-up table 504, a memory controller 502, a display controller 505, an adder 506, a digital to analog converter 507 (DAC), and a comparator 503. The memory 501 may be configured to store a plurality of input data patterns, corresponding to N lines of the display panel 508, to be displayed for a plurality of predefined display time intervals. In one aspect, each two adjacent display time intervals may be separated via a blanking time interval. The plurality of input data patterns may comprise pixel data corresponding to each of the N lines for each display time interval. The comparator 503 may be configured to receive input data patterns corresponding to N lines for a preceding display time interval from the memory. The comparator 503 may be configured to compare difference between a pixel data associated with a pixel of a current line, of the N lines of the display panel 508, and a pixel data associated with a corresponding pixel of a preceding line, of the N lines of the display panel 508, corresponding to the preceding display time interval with a predefined threshold. The display controller 505 may determine a rescan pattern corresponding to the last predetermined lines of the blanking time interval between the preceding time interval and a current display time interval. The display controller 505 may be configured to determine the rescan pattern by driving the pixel data associated with the pixels of the N lines corresponding to the preceding display time interval during the blanking time interval between the preceding display time interval and the current display time interval. The pixel data may be driven using a look-up table 504 to modify or retain the value of the pixel data associated with the pixels of the N lines based upon the difference between the pixel data associated with each pixel of the current line and the pixel data associated with the corresponding pixel of the preceding line being greater than a predefined threshold, and less than or equal to the predefine threshold respectively. The display panel 508 may be configured to display input data patterns for the current display time interval after the blanking time interval having the last predetermined number of lines with the rescan pattern such that, the display characteristics of the input data patterns corresponding to the current display time interval are in coherent with the display characteristics of the input data patterns corresponding to the preceding display time interval. In one embodiment, the display characteristics include at least brightness and dimming effects.

In one embodiment, the display panel 508 may be configured to exhibit plurality of display patterns. In one embodiment, the input data patterns may include raster video data. In one embodiment, the rescan may be performed by low or high compensation values i.e. $\Delta_{RS_L}$ or $\Delta_{RS_H}$.

Figure 6:
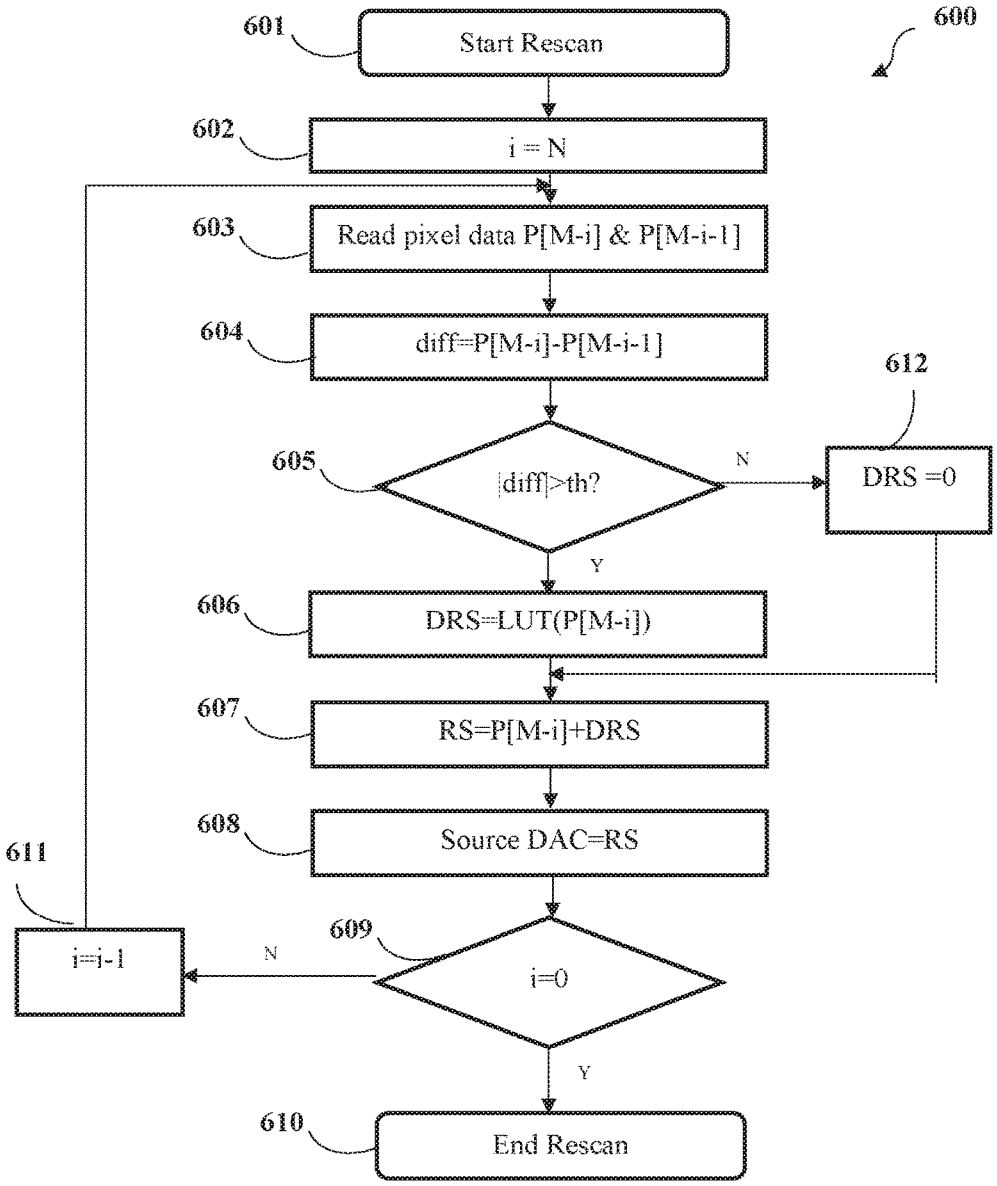
FIG. 6 illustrates a flowchart 600 for rescan, in accordance with the embodiment of the present application.

Now, referring to FIG. 6, a flowchart 600 for rescan is illustrated, in accordance with the embodiment of the present application. At step 601, the rescan process may be initiated.

At step 602, the data in the memory may be read out. The data may correspond to N lines.

At step 603, the pixel data of current and preceding lines may be read. In one embodiment, the pixel data of M−i and M−i−1 may be read and compared.

At step 604, the difference between the current line and preceding line (i.e. |diff|) may be calculated. In one embodiment, the difference of pixel data between M−i and M−i−1 may be calculated.

At step 605, the difference of the pixel data (|diff|) may be compared with a predefined threshold. The predefined threshold may be representing 0-255 levels. The predefined threshold may be adjusted according to the panel characteristics. Generally, for small loading panels, the value of predefined threshold may be large, therefore the data manipulation may not be required for most of the input pattern. In case of heavy loading panels, the value of predefined threshold can be small, therefore data manipulation may be required for most of the input pattern.

At step 606, the data rescan may be performed if the difference in the pixel data (|diff|) is greater than the predefined threshold (th). The data rescan may be performed using a look-up table to obtain a data rescan value (DRS). Alternatively, at step 612, the data rescan may not be performed if the difference in the pixel data (|diff|) is not greater than the predefined threshold (th) and accordingly update the data rescan value (DRS) equal to zero.

At step 607, the rescan value (RS) may be calculated. In one embodiment, the rescan value may be the summation of values of M−i| and the data rescan value (DRS) obtained at a preceding step.

At step 608, the digital to analog converter may be equated to the rescan value calculated at step 607.

At step 609, the value stored in the memory may be checked. In one embodiment, in case the value may equal to zero, then at step 610, the rescan may be terminated. Alternatively, at step 611, a preceding line may be processed for the rescan by repeating the steps 603-608 for the preceding line.

Figure 7A:
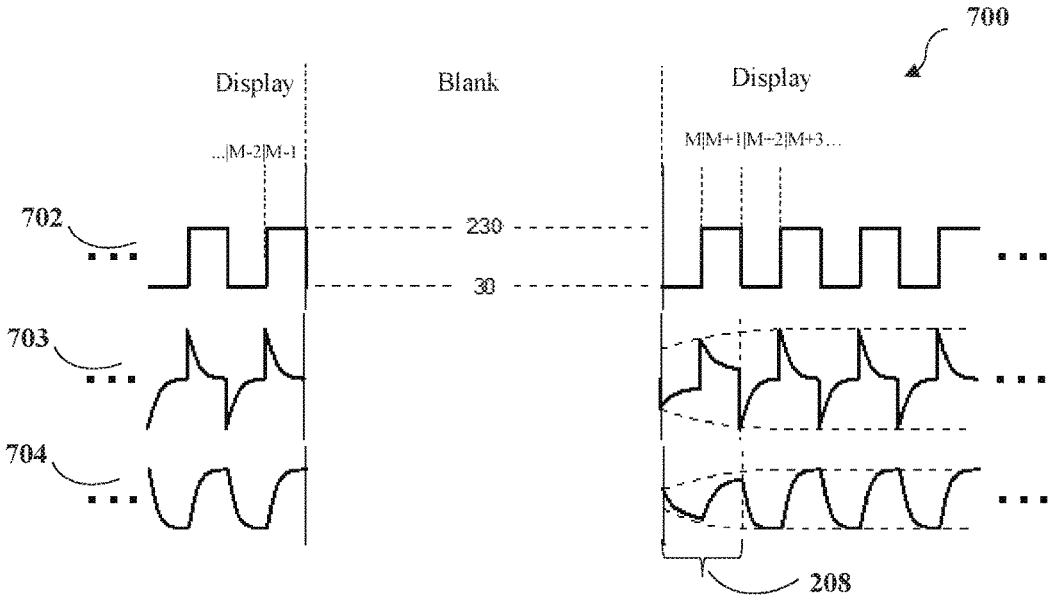
FIGS. 7(*a*), 7(*b*), 8(*a*), 8(*b*), 9(*a*) and 9(*b*) illustrate rescan value determination, in accordance with embodiments of the present application.
Figure 7B:
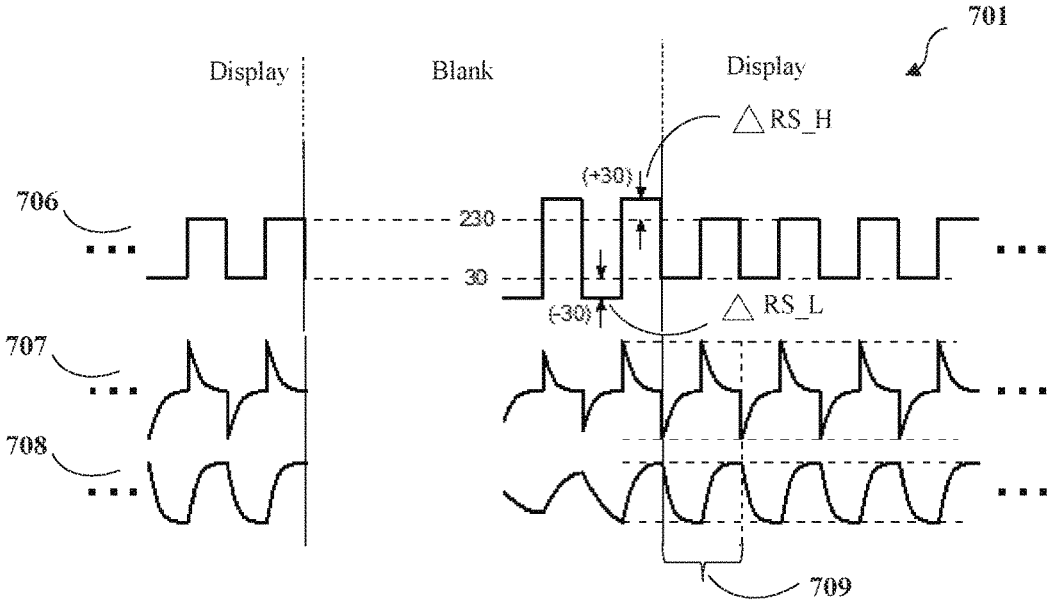

Now referring to FIGS. 7(*a*) and 7(*b*), an exemplary embodiment for determining rescan value is illustrated. In one example, in case the difference of (M−n) line and (M−n+1) line pixel data may be larger than the predefined threshold, then the rescan may be performed. When the display resumes from the blanking time interval, first few scan lines 208 may appear to be non-uniform in brightness (similar to the effect seen in FIG. 2(*a*).

Figure 10A:
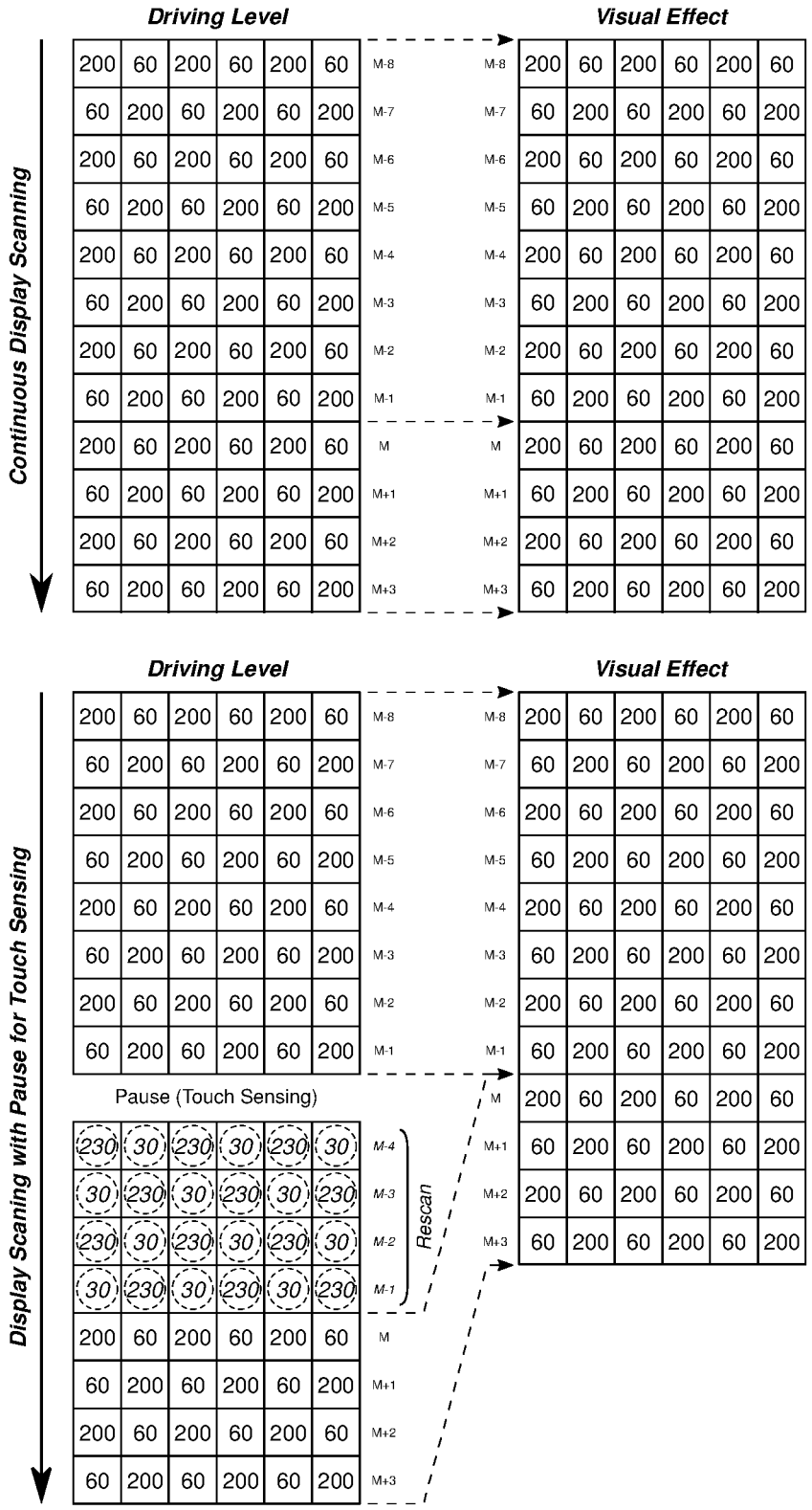
FIGS. 10(*a*), 10(*b*) and 10(*c*) illustrate original data in three different cases.
Figure 10B:
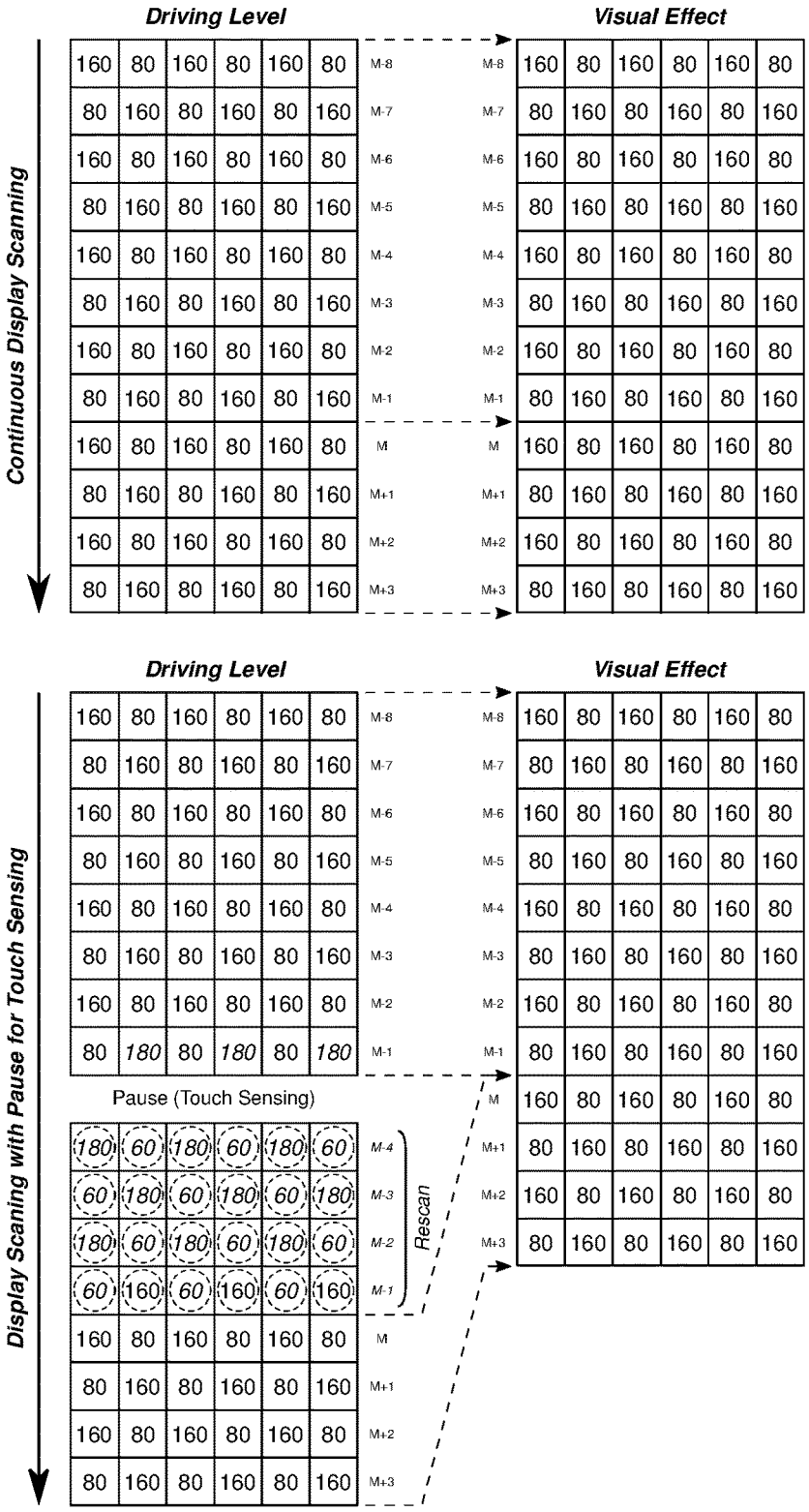
Figure 10C:
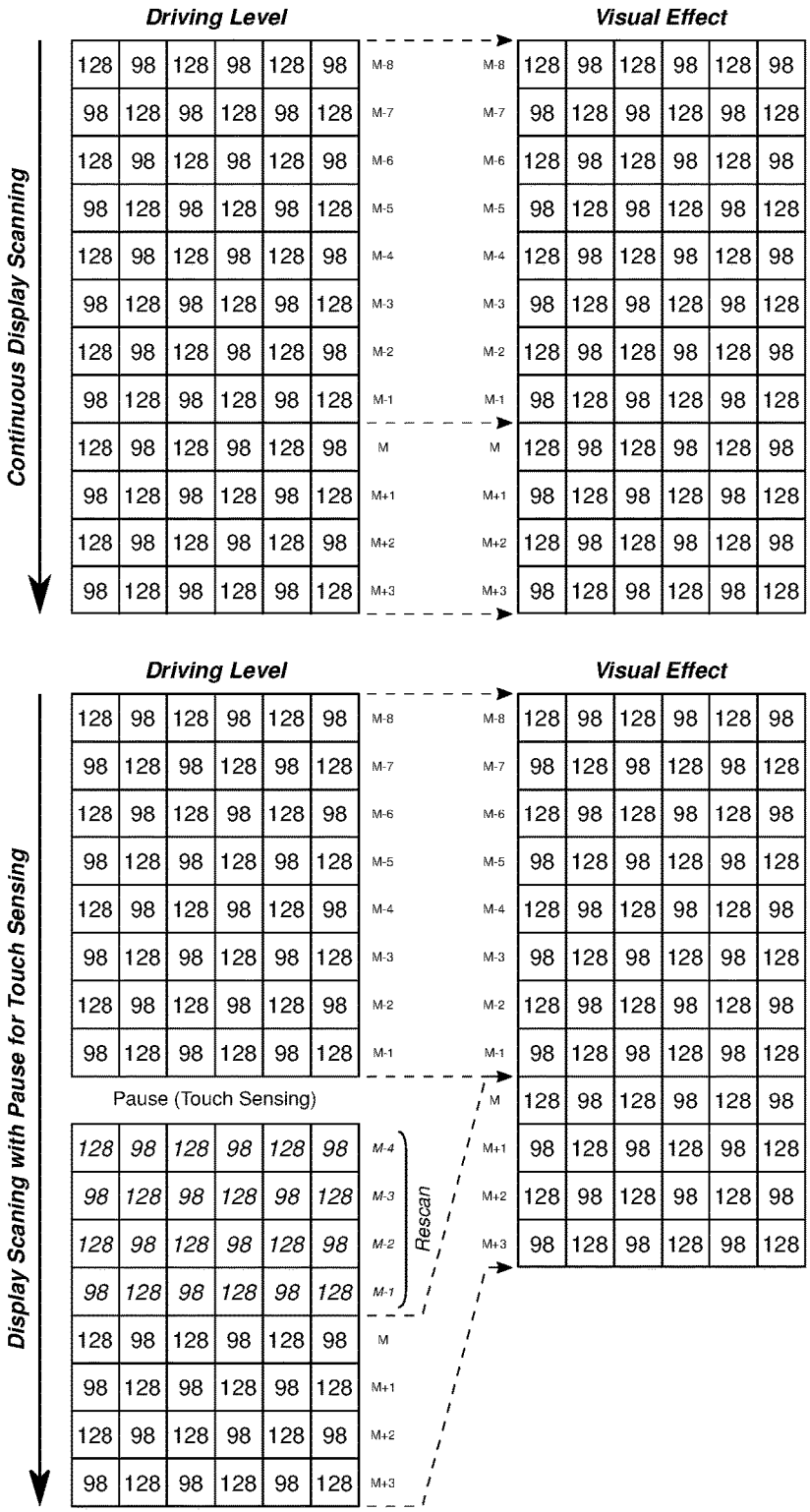

In one embodiment, assume a predefined threshold value=60, the original high pixel data=200, and original low pixel data=60. Therefore, in this case, the processed pixel data may change to 230 for high and 30 for low as $\Delta_{RS_L}$=−30 and $\Delta_{RS_H}$=+30. FIG. 10(*a*) illustrates original data to obtain modified data.

Figure 8A:
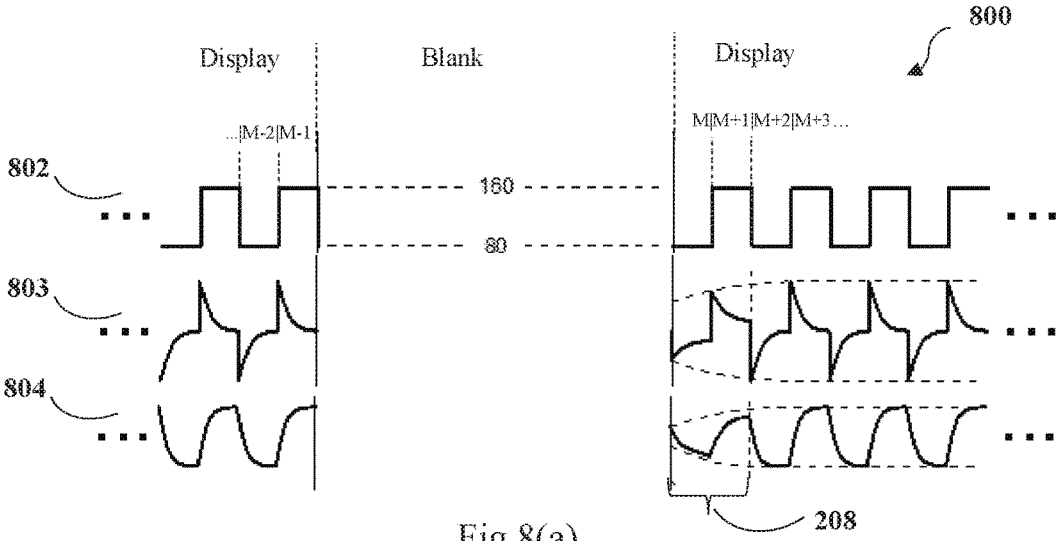
Figure 8B:
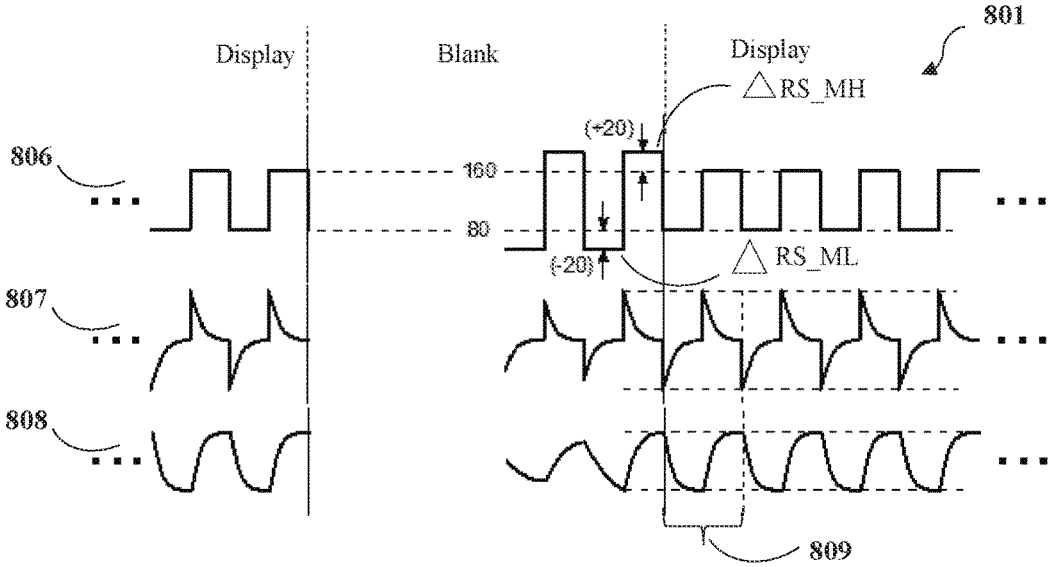

Now referring to FIGS. 8(*a*) and 8(*b*), another exemplary embodiment for determining a rescan value is illustrated. In one example, in case the difference of (M−n) line and (M−n+1) line pixel data may be larger than the predefined threshold, then the rescan may be performed. When the display resumes from the blanking time interval, first few scan lines 208 may appear to be non-uniform in brightness (similar to the effect seen in FIG. 2(*a*). In one embodiment, assume a predefined threshold value=60, the original high pixel data=160, and original low pixel data=80. Therefore, in this case, the processed pixel data may change to 180 for high and 60 for low as $\Delta_{RS_}$ML=−20 and $\Delta_{RS_MH}$=+20. FIG. 10(*b*) illustrates original data to obtain modified data.

Figure 9A:
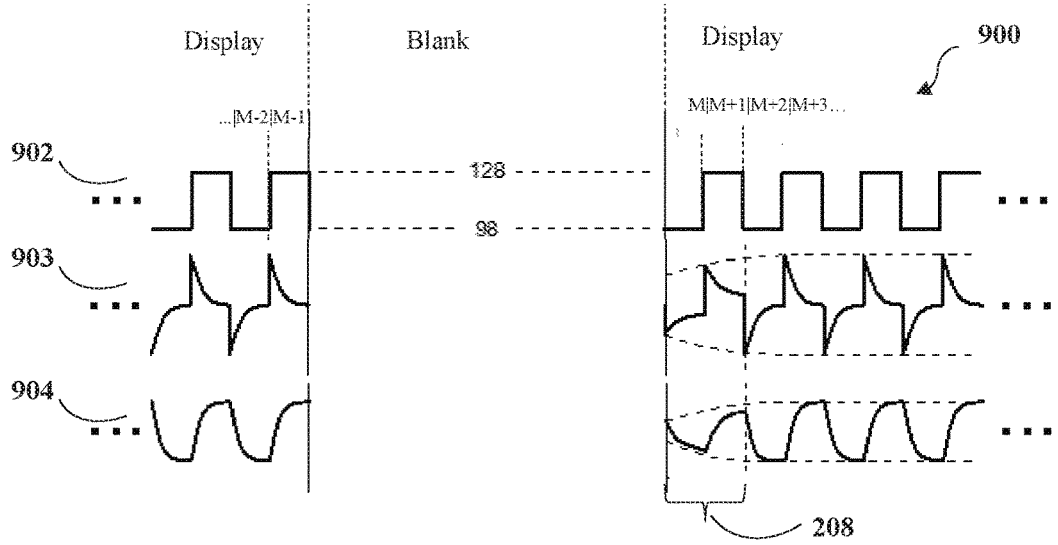
Figure 9B:
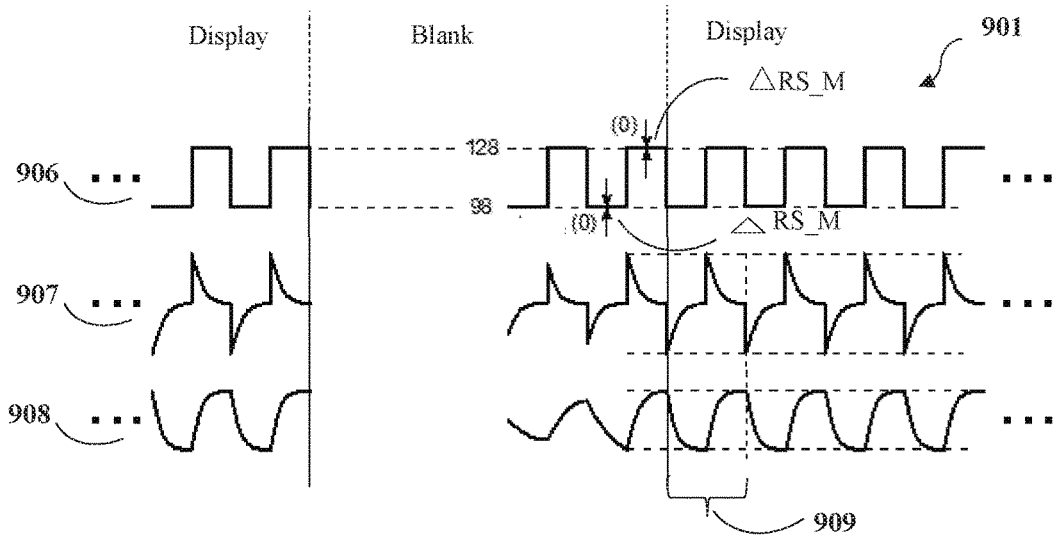

Now referring to FIGS. 9(*a*) and 9(*b*), another exemplary embodiment for determining a rescan value is illustrated. In one example, in case the difference of (M−n) line and (M−n+1) line pixel data may not exceed the predefined threshold, then the rescan may not be performed. When the display may resume from the blanking time interval, first few scan lines 208 may appear to be non-uniform in brightness (similar to the effect seen in FIG. 2(*a*). In one embodiment, assume a predefined threshold value=60, the original high pixel data=128, and original low pixel data=98. FIG. 10(*c*) illustrates original data to be retained.

Although implementations for a system and method for enhancing display uniformity at display boundaries have been described in language specific to structural features and/or methods, it is to be understood that the appended claims are not necessarily limited to the specific features or methods described. Rather, the specific features and methods are disclosed as examples of implementations for a system and method for enhancing display uniformity at display boundaries.

What is claimed is:

1. A system for enhancing display uniformity at display boundaries, comprising:

a memory configured to store a plurality of input data patterns, corresponding to N lines of a display panel, to be displayed for a plurality of predefined display time intervals, wherein each two adjacent display time intervals are separated via a blanking time interval, wherein the plurality of input data patterns comprises pixel data corresponding to each of the N lines for each display time interval;

a comparator configured to receive input data patterns corresponding to N lines for a preceding display time interval from the memory and compare difference between a pixel data associated with a pixel of a current line, of the N lines of the display panel, and a pixel data associated with a corresponding pixel of a preceding line, of the N lines of the display panel, corresponding to the preceding display time interval with a predefined threshold;

a display controller configured to determine a rescan pattern corresponding to the last predetermined number of lines of the blanking time interval between the preceding time interval and a current display time interval, wherein said rescan pattern is determined by driving the pixel data associated with the pixels of the N lines corresponding to the preceding display time interval during the blanking time interval between the preceding display time interval and a current display time interval, wherein the pixel data is driven using a look-up table to modify or retain the value of the pixel data associated with the pixels of the N lines based upon the difference between the pixel data associated with each pixel of the current line and the pixel data associated with the corresponding pixel of the preceding line being greater than a predefined threshold, and less than or equal to the predefine threshold respectively; and the display panel configured to display input data patterns corresponding to the current display time interval after the blanking time interval having the last predetermined number of lines with the rescan pattern such that, the display characteristics of the input data patterns corresponding to the current display time interval are in coherent with the display characteristics of the input data patterns corresponding to the preceding display time interval.

2. The system for enhancing display uniformity at display boundaries of claim 1, wherein the comparator compares the difference between M−(N−1) line and M−N line, wherein 'M' represents the number of lines on the display panel, and wherein value of N is within 0 to M.

3. The system for enhancing display uniformity at display boundaries of claim 1, wherein the rescan is performed by low or high compensation values i.e. $\Delta_{RS_L}$ or $\Delta_{RS_H}$ stored in the look-up table.

4. The system for enhancing display uniformity at display boundaries of claim 3, wherein the predefined threshold is adjusted according to the display panel characteristics.

5. The system for enhancing display uniformity at display boundaries of claim 4, wherein the predefined threshold is large for small loading panels and a small predefined threshold for heavy panel load.

6. The system for enhancing display uniformity at display boundaries of claim 5, wherein the rescan is a recurring process.

7. The system for enhancing display uniformity at display boundaries of claim 6, wherein the visual performance of the first few display lines is same as others before entering a display time interval.

8. The system for enhancing display uniformity at display boundaries of claim 7, wherein the rescanned display lines are provided at the end of the blanking time interval in order to make behaviors of display electrodes similar with those at the end of the last display time interval, for the electrodes to enable a new display time interval.

9. The system for enhancing display uniformity at display boundaries of claim 1, wherein the display panel comprises a common electrode (VCom) capable of being adjusted in order to strengthen or weaken driving capabilities of the lines of the display panel.

10. The system for enhancing display uniformity at display boundaries of claim 1, wherein a gate/MUX timing is adjustable for different TFT on time.

11. A method for enhancing display uniformity at display boundaries, the method comprising:

storing, via a memory, a plurality of input data patterns, corresponding to N lines of a display panel, to be displayed for each display time interval of a plurality of predefined display time intervals, wherein each two adjacent display time intervals are separated via a blanking time interval, wherein the plurality of input data patterns comprises pixel data corresponding to each of the N lines for each display time interval;

comparing, via the comparator, difference between a pixel data associated with a pixel of a current line, of the N lines of the display panel, and a pixel data associated with a corresponding pixel of a preceding line, of the N lines of the display panel, corresponding to the preceding display time interval with a predefined threshold;

determining, via display controller, a rescan pattern corresponding to the last predetermined number of lines of the blanking time interval between the preceding time interval and a current display time interval;

driving, via a display controller, the pixel data associated with the pixels of the N lines corresponding to the preceding display time interval during the blanking time interval between the preceding display time interval and a current display time interval, wherein the pixel data is driven using a look-up table to modify or retain the value of the pixel data associated with the pixels of the N lines based upon the difference between the pixel data associated with each pixel of the current line and the pixel data associated with the corresponding pixel of the preceding line being greater than a predefined threshold, and less than or equal to the predefine threshold respectively; and displaying, via the display panel, input data patterns corresponding to the current display time interval after the blanking time interval having the last predetermined number of lines with the rescan pattern such that, the display characteristics of the input data patterns corresponding to the current display time interval are in coherent with the display characteristics of the input data patterns corresponding to the preceding display time interval.

12. The method for enhancing display uniformity at display boundaries of claim 11, wherein the predefined threshold is adjusted according to the display panel characteristics.

13. The method for enhancing display uniformity at display boundaries of claim 11, wherein the predefined threshold is large for small loading panels and a small predefined threshold for heavy panel load.

14. The method for enhancing display uniformity at display boundaries of claim 11, wherein the rescan is a recurring process.

15. The method for enhancing display uniformity at display boundaries of claim 12, wherein the visual performance of the first few display lines is same as others before entering a display time interval.

16. The method for enhancing display uniformity at display boundaries of claim 14, wherein the rescanned display lines are provided at the end of the blanking time interval in order to make behaviors of display electrodes similar with those at the end of the last display time interval, for the electrodes to enable a new display time interval.

17. The method for enhancing display uniformity at display boundaries of claim 11, wherein the display characteristics comprise at least brightness and dimming effects.

* * * * *